US005649743A

United States Patent [19]

Skalka

[11] Patent Number: 5,649,743

[45] Date of Patent: Jul. 22, 1997

[54] VANDAL-RESISTANT BENCH AND FRAME THEREFOR

[75] Inventor: Gerald P. Skalka, Potomac, Md.

[73] Assignee: Victor Stanley, Inc., Dunkirk, Md.

[21] Appl. No.: 380,976

[22] Filed: Jan. 31, 1995

[51] Int. Cl.[6] ..... A47C 7/02

[52] U.S. Cl. ..... 297/452.19; 297/452.11; 297/445.1

[58] Field of Search ..... 297/232, 440.22, 297/448.1, 449.1, 445.1, 452.18, 463.1, 452.19, 451.3, 447.3, 446.1, 452.11; 403/337, 361, 381

[56] References Cited

U.S. PATENT DOCUMENTS

| | | | |
|---|---|---|---|
| 7,539 | 7/1850 | Warren | 297/232 |
| 2,630,158 | 3/1953 | Davis et al. | 297/445.1 |
| 3,230,005 | 1/1966 | Staples . | |
| 3,482,874 | 12/1969 | Henebry et al. | 297/445.1 |
| 3,669,497 | 6/1972 | Massonnet . | |
| 3,873,155 | 3/1975 | Barecki | 297/440.22 X |
| 3,887,230 | 6/1975 | Gröning et al. . | |
| 4,057,214 | 11/1977 | Harder, Jr. | 297/452.18 X |
| 4,761,036 | 8/1988 | Vogel | 297/452.18 |
| 4,848,843 | 7/1989 | Gibbs | 297/440.22 |

*Primary Examiner*—Milton Nelson, Jr.
*Attorney, Agent, or Firm*—Reid & Priest L.L.P.

[57] ABSTRACT

A vandal-resistant article of furniture comprises left and right mirror-image frames, and a seating area extending between and fastened to the seat portions of the left and right frames. Each frame includes a seat portion, a base portion, and a locking cap or spacer at the joint between the seat and base portions. Male portions of forward and rearward dove-tail half-lap joints and forward and rearward fastener seats are formed in the lower surface of the seat portion. Female portions of the joints are formed at the upper end of the base portion and respectively matingly receive the male portions. The upper end of the base portion also includes a lateral rib or spaced shoulders offset from the male portions of the joints. Forward and rearward nut seats can be provided to prevent rotation of nuts seated therein. The optional locking cap includes a laterally-extending wedge portion inserted between the forward and rearward fastener seats and the lateral rib for aligning the seat and base portions. Forward and rearward fasteners are inserted through aligned notches or apertures formed in the lower surface of the seat portion at the fastener seats, in the spacer or the wedge portion of the locking cap, and in the upper end of the base portion.

45 Claims, 6 Drawing Sheets

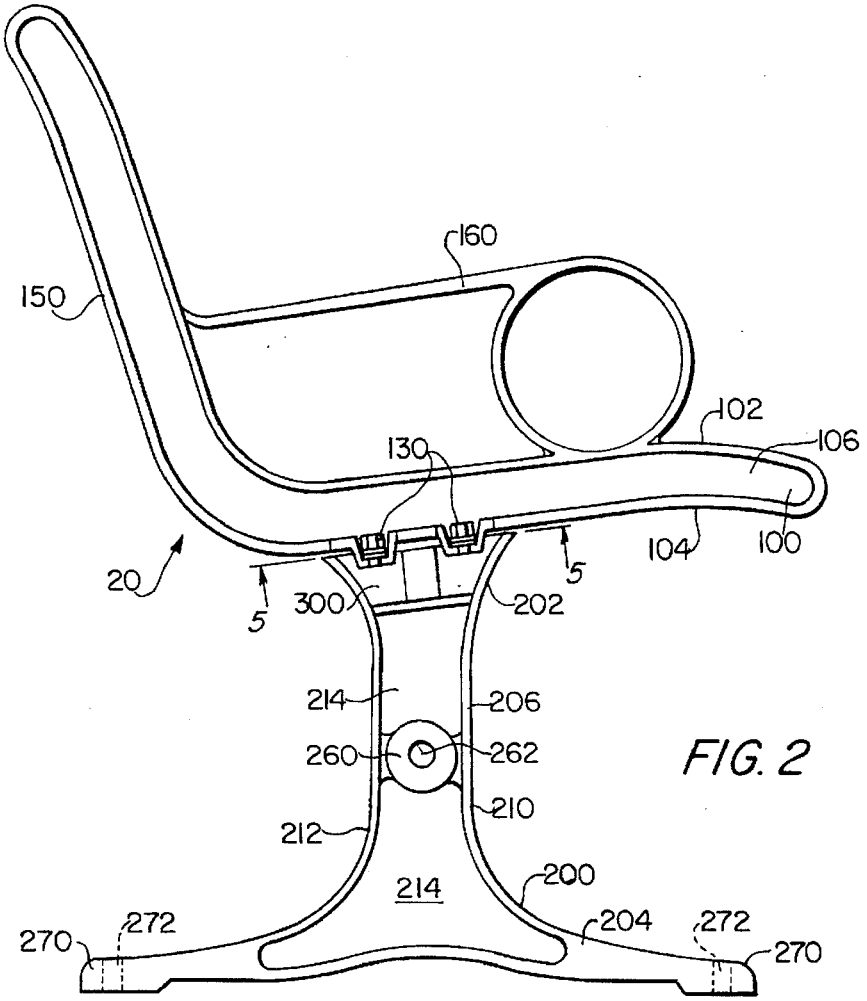
FIG. 2
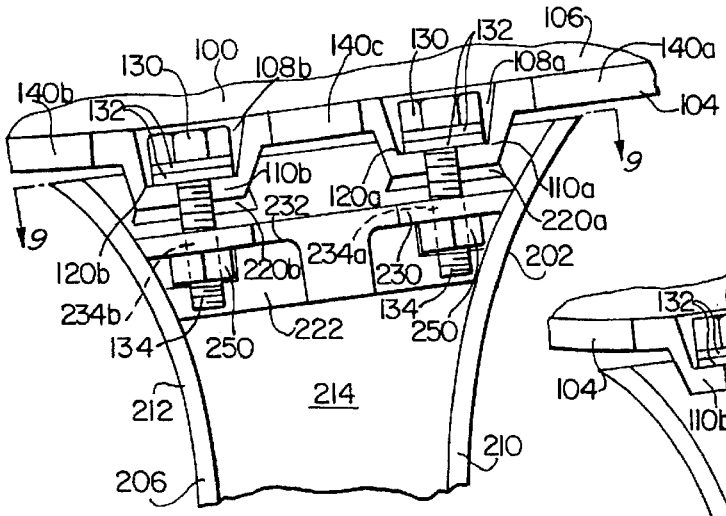
FIG. 3
FIG. 4
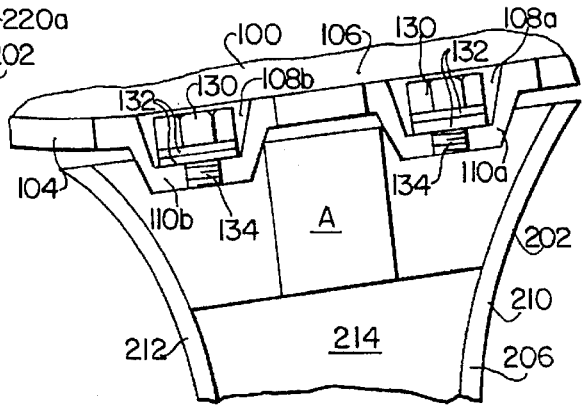

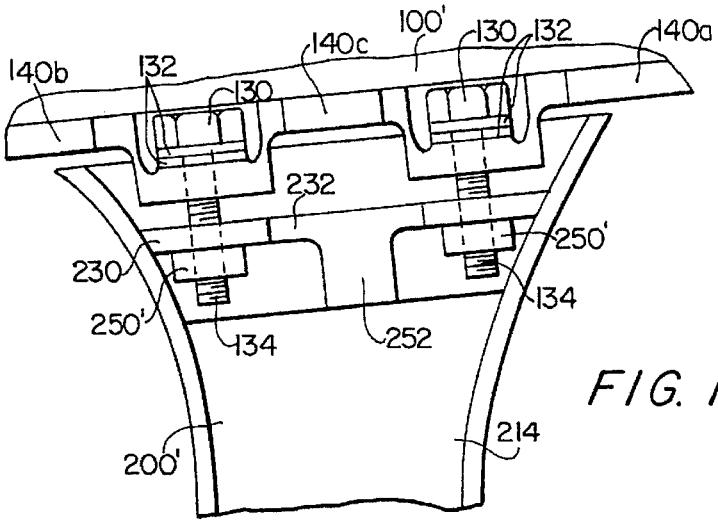
FIG. 12
FIG. 13
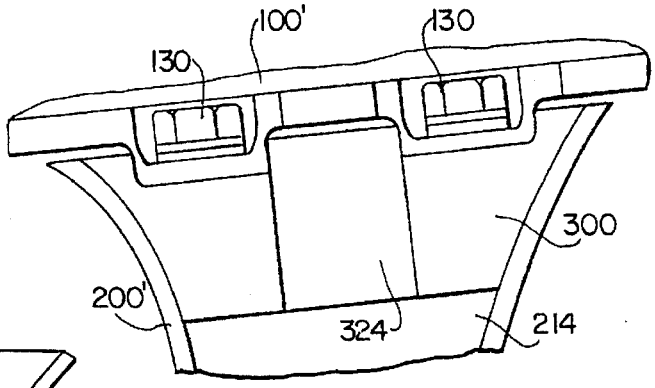
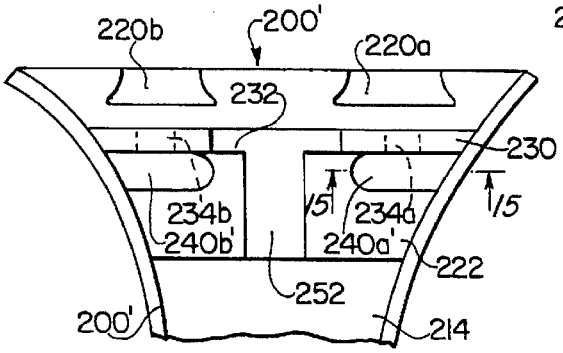
FIG. 14
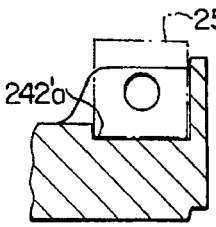
FIG. 15
FIG. 16
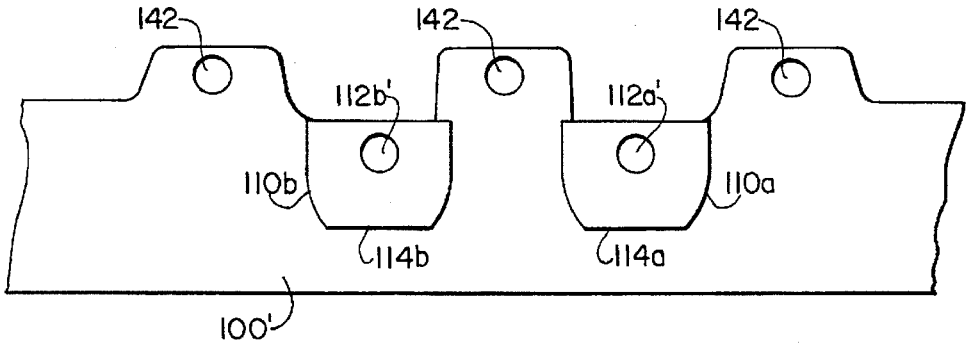

VANDAL-RESISTANT BENCH AND FRAME THEREFOR

BACKGROUND OF THE INVENTION

1. Field of the Invention

The present invention relates to benches of the type comprising a plurality of horizontally-extending slats supported by two spaced metal end frames. More specifically, the invention relates to such benches in which the various components are fastened together in a manner which renders them vandal-resistant.

2. Related Art

Benches intended for outdoor use, particularly in public areas, typically comprise two spaced frames supporting between them a seating section formed of a plurality of horizontally-extending wood or metal slats, or an integral seating section formed of welded steel, perforated metal wire mesh, or plastic. Typically, the frames are fabricated of cast concrete, cast iron, or welded steel. Although cast iron frames provide aesthetic advantages, they present a number of technical and economic disadvantages. For example, the pattern cost for one leg is enormous, and two legs—a left and a right—are generally required. Any change in the design, for example to add, omit, or change the shape of arms or ornamentation, requires the production of an entirely new pattern. Also, a single piece the size and shape of a bench frame, with its different thicknesses, tends to twist and warp when taken out of the sand in which it is cast. The twisting and warpage is of sufficient magnitude in a significant percentage of the pieces that they cannot be used. Further, their large size makes the pieces unsuitable for casting using an automatic machine. Finally, in a typical frame design, the screws holding the seating area in place are easily accessibly, allowing the bench as a whole to be easily vandalized.

It is the solution of these and other problems to which the present invention is directed.

SUMMARY OF THE INVENTION

It is therefore a primary object of the present invention to provide a cast iron bench frame which can be cast without any significant twisting and warping.

It is another object of the present invention to provide a cast iron bench frame which is at least in part suited to production using automatic casting machines.

It is another object of the present invention to provide a cast iron bench frame which is modular, so as to facilitate design changes and reduce the technical and economic problems associated with single-piece frames.

It is still another object of the present invention to provide a cast iron bench frame which, when assembled with a plurality of horizontally-extending slats or other seating area such as pre-welded steel bars, is highly tamper resistant.

These and other objects of the present invention are achieved by providing a vandal-resistant article of furniture comprising left and right mirror-image frames, and a seating area extending between and fastened to the seat portions of the left and right frames. The seating area can comprise a plurality of horizontally-extending slats or section of welded or woven wire, perforated metal, plastic, or a plurality of pre-welded steel bars. Each frame includes a seat portion and a base portion. A locking cap with an integral spacer can be provided to cover the joint between the seat and base portions. Alternatively, a spacer can be provided at the joint between the seat and base portions.

The seat portion has an upper surface and a lower surface. Forward and rearward adjacent male portions of a locking joint are formed integrally with the lower surface, and forward and rearward fastener seats are formed in the lower surface above the forward and rearward male portions of the locking joint. The locking joint preferably is a pair of dovetail half-lap joints.

The base portion is formed separately from the seat portion. It includes a seat-supporting upper end and a ground-engaging lower end, the upper end having formed therein forward and rearward female portions of the locking joint which respectively matingly receive the forward and rearward male portions of the locking joint. In the embodiment where a locking cap is used, a lateral rib extends across the upper end offset from the forward and rearward male portions of the locking joint. Forward and rearward nut seats are also formed in the upper end below the lateral rib. The forward and rearward nut seats are configured either to prevent rotation of nuts seated therein, or to provide sufficient area for tapped holes.

The locking cap includes a laterally-extending wedge portion inserted between the forward and rearward fastener seats and the lateral rib for aligning the facing surfaces of seat and base portions. In the alternate embodiment in which a spacer is used, the spacer is inserted between the forward and rearward fastener seats and projecting shoulders formed in the upper end of the base portion downwardly of the female portion of the locking joint.

Forward and rearward fasteners are inserted through aligned notches or apertures formed in the lower surface of the seat portion at the fastener seats, in the spacer or the wedge portion of the locking cap, and in the upper end of the base portion.

Alternatively, the locking cap can be omitted, and the shoulder of the lower dovetail can be drilled and tapped to receive the fasteners.

In another aspect of the invention, the nut seats are configured to receive hexagonal nuts. Alternatively, the nut seats are configured to receive square nuts.

In still another aspect of the invention, nut seats are also provided in the interior surface of the locking cap in alignment with and acting together with the nut seats in the upper end of the base portion, to prevent rotation of the nuts when torque is applied to the fasteners.

Once assembled in either embodiment, the seating area renders the fasteners and dovetail joints hidden and inaccessible.

BRIEF DESCRIPTION OF THE DRAWINGS

The invention is better understood by reading the following Detailed Description of the Preferred Embodiments with reference to the accompanying drawing figures, in which like reference numerals refer to like elements throughout, and in which:

FIG. 2 is an elevational view of the inner side of the vandal-resistant frame of FIG. 1.

FIG. 3 is an enlarged elevational view of the joint between the seat and base portions of the vandal-resistant frame of FIG. 1, with the locking cap removed.

FIG. 4 is an elevational view of the joint shown in FIG. 3, with the locking cap in place.

FIG. 12 is an enlarged elevational view of the joint between the seat and base portions of a second embodiment of a vandal-resistant frame in accordance with the present invention, with the locking cap removed.

FIG. 13 is an elevational view of the joint shown in FIG. 12, with the locking cap in place.

FIG. 14 is an elevational view of the upper end of the base portion shown in FIG. 12.

FIG. 15 is a cross-sectional view taken along line 15—15 of FIG. 14.

FIG. 16 is fragmentary bottom plan view of the seat portion shown in FIG. 12.

DETAILED DESCRIPTION OF THE PREFERRED EMBODIMENTS

Figure 1:
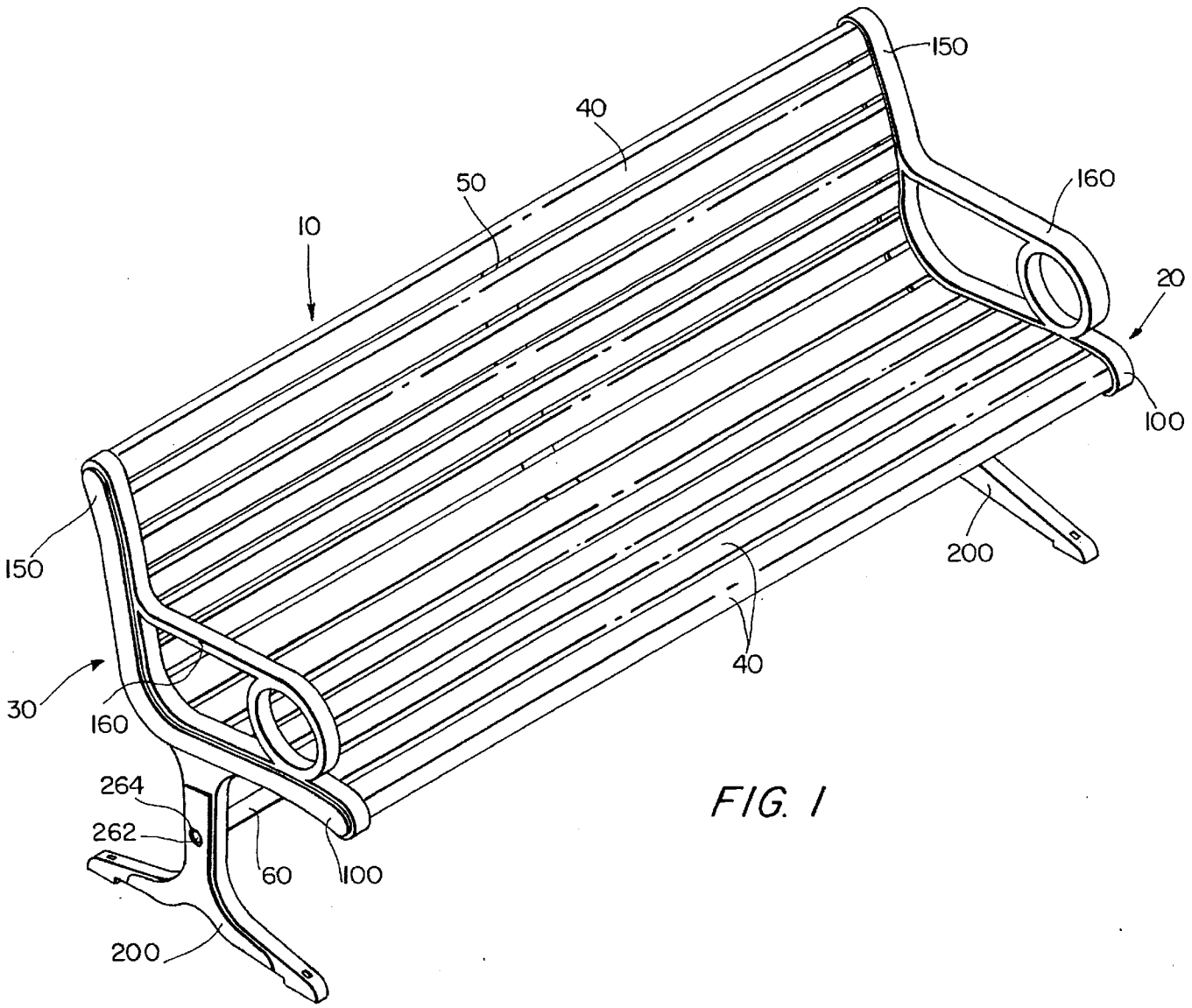
FIG. 1 is a perspective view of a bench incorporating a first embodiment of a vandal-resistant frame in accordance with the present invention.
Figure 5:
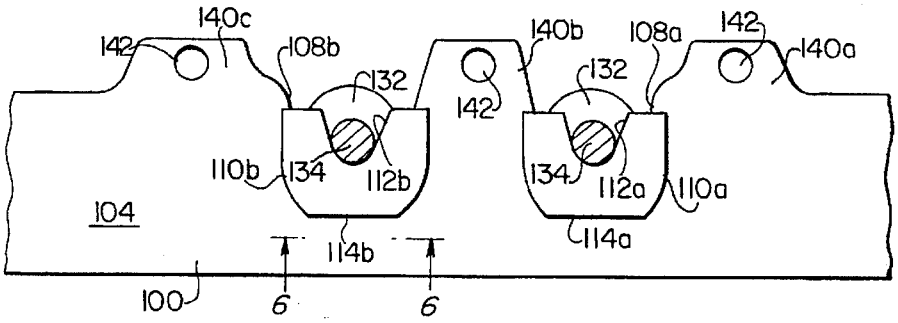
FIG. 5 is a cross-sectional view taken along line 5—5 of FIG. 1.
Figure 6:
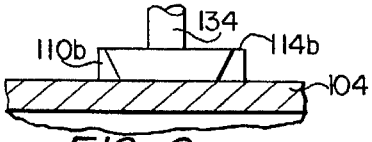
FIG. 6 is a cross-sectional view taken along line 6—6 of FIG. 5.
Figure 7:
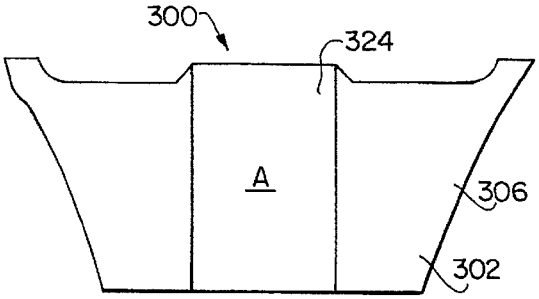
FIG. 7 is an elevational view of the outside surface of the locking cap.
Figure 8:
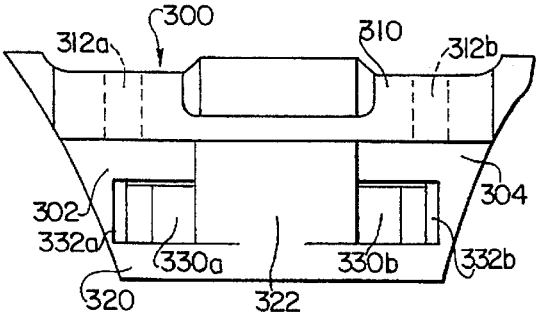
FIG. 8 is an elevational view of the inside surface of the locking cap.
Figure 9:
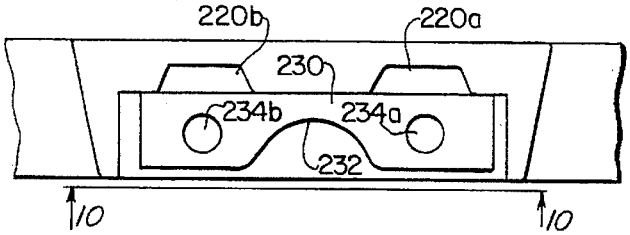
FIG. 9 is a cross-sectional view taken along line 9—9 of FIG. 3.
Figure 10:
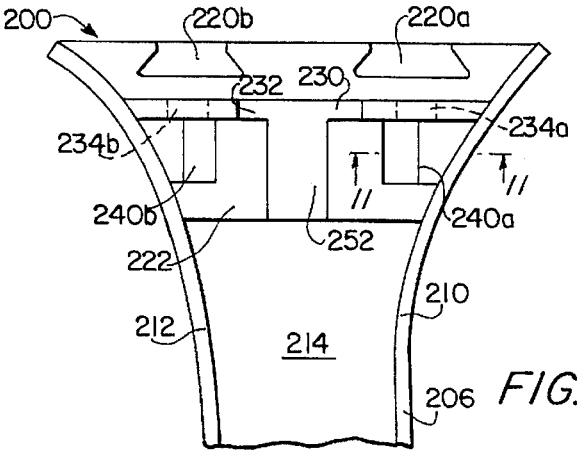
FIG. 10 is an elevational view of the upper end of the base portion of the frame of FIG. 1.
Figure 11:
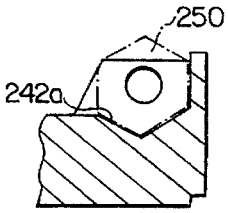
FIG. 11 is a cross-sectional view taken along line 11—11 of FIG. 10.

In describing preferred embodiments of the present invention illustrated in the drawings, specific terminology is employed for the sake of clarity. However, the invention is not intended to be limited to the specific terminology so selected, and it is to be understood that each specific element includes all technical equivalents which operate in a similar manner to accomplish a similar purpose.

Referring now to FIGS. 1 and 2, there is shown a vandal-resistant bench 10 in accordance with a first embodiment of the present invention. Bench 10 comprises left and right vandal resistant frame assemblies 20 and 30, a seating area formed, for example, by a plurality of horizontally-extending slats 40 supported by left and right frame assemblies 20 and 30, a center brace 50 attached to the rear or lower surfaces of slats 40 intermediate left and right frame assemblies 20 and 30, and a crossbar 60 extending between and affixed to left and right vandal resistant frame assemblies 20 and 30. The seating area can alternatively be formed by a plurality of parallel, spaced, pre-welded steel bars or other components which can be fitted between frame assemblies 20 and 30 in substantially the same manner as slats 40 as described hereinafter.

Frame assemblies 20 and 30 are mirror images of each other, and each includes a seat portion 100, a base portion 200, and a locking cap 300 for aligning and covering the locking joint between seat and base portions 100 and 200. Preferably, seat portion 100, base portion 200, and locking cap 300 are all cast iron. The reduced size of seat portion 100 and base portion 200 increases the opportunity to cast the sections on readily available automatic machines. For example, using the automatic machine, base portions can be output at a rate of 50 per hour, in contrast, conventional one-piece frames conventionally cast in sand can only be output at a rate of 50 per 8 hours. Also, unlike conventional one-piece frames, which are too heavy to be lifted by all but the strongest individuals, seat and base portions 100 and 200 are small and light enough to be lifted by individuals of average strength.

Referring more particularly to FIGS. 3–11, a first embodiment of a vandal-resistant frame assembly 10 in accordance with the present invention will now be described. Seat portion 100 includes upper and lower surfaces 102 and 104 and a channel 106 formed between upper and lower surfaces 102 and 104 for receiving the ends of slats 40. Forward and rearward notches 108*a* and 108*b* are formed in lower surface 104, with forward and rearward adjacent shoulders 110*a* and 110*b* extending downwardly from and formed integrally with lower surface 104 at notches 108*a* and 108*b*. Forward and rearward shoulders 110*a* and 110*b* also have notches 112*a* and 112*b* formed therein, at their inwardly-facing edges.

The outwardly-facing edges of shoulders 110*a* and 110*b* are formed as the male portions 114*a* and 114*b* of the locking joint between seat and base portions 100 and 200, and specifically, as the male portions of forward and rearward dovetail half-lap joints. The upper surfaces 120*a* and 120*b* of shoulders 110*a* and 110*b* define forward and rearward fastener seats for seating the heads 130 of fasteners such as a bolt, as well as washers 132 (preferably including at least one locking washer). The shafts 134 of fasteners extend through notches 112*a* and 112*b* in shoulders 114*a* and 114*b*, as will be described in greater detail hereinafter.

Forward, rearward, and middle projections 140*a*, 140*b*, and 140*c* respectively are formed at the inwardly-facing edge of lower surface 104. Spaced apertures 142 are formed inset from the inwardly faces edge of lower surface 104 and through projections 140*a*, 140*b*, and 140*c*, for a purpose to be described hereinafter.

A backrest 150 can be formed as a unitary extension of seat portion 100, while an armrest 160 can be formed unitarily with seat portion 100 and backrest 150 as a connector between the two. As will be appreciated by those of skill in the art, seat portion 100 can be varied in numerous ways, for example, by omitting the backrest 150 and the armrest 160; or by omitting the backrest 150 and forming the armrest 160 unitarily as an extension from seat portion 100 only.

Base portion 200 includes a seat-supporting upper end 202, a ground-engaging lower end 204, an intermediate portion 206 between upper and lower ends 202 and 204, and front and back surfaces 210 and 212. An inwardly-facing channel 214 is formed between front and back surfaces 210 and 212. As illustrated in the figures, base portion 200 is in the form of a pedestal having the shape of an inverted "T." However, as will be appreciated by those of ordinary skill in the art, other configurations which permit inclusion of the locking joint as described below are possible. One such configuration is described with respect to FIGS. 17–22.

Forward and rearward adjacent female portions 220*a* and 220*b* of the forward and rearward dovetail half-lap joints are formed in the inwardly-facing surface of upper end 202 for respectively matingly receiving forward and rearward male portions 114*a* and 114*b*. Dovetail half-lap joints are preferred for the joints between seat and base portions 100 and 200 because of their self-aligning nature. However, other self-aligning joints can also be used.

A transverse raised portion 222 formed in the inwardly-facing surface of upper end 202 terminates at its upper end in a transverse projecting rib 230 spaced downwardly from female portions 220*a* and 220*b* and extending between front and back surfaces 210 and 212. A central, U-shaped notch 232 is formed at the inwardly-facing edge of rib 230, for a purpose to be described hereinafter. Forward and rearward apertures 234*a* and 234*b* are formed in rib 230 to either side of U-shaped notch 232, in alignment with notches 112*a* and 112*b*, for receiving shafts 134 of the fastening bolts.

Forward and rearward recesses 240*a* and 240*b* are formed in raised portion 222 downwardly of rib 230. Recesses 240*a* and 240*b* are triangular in transverse cross-section, and define the inner portions of nut seats for seating hexagonal nuts 250 which threadingly engage shafts 134 of the fastening bolts. When base portion 200 is resting on a horizontal support surface, the forward and rearward nut seats have coplanar upper surfaces forming an angle with the horizontal tilting downwardly from front to back. A semi-cylindrical longitudinal depression 252 is also formed in raised portion 222 in alignment with U-shaped notch 232, also for a purpose to be described hereinafter.

In order to retain crossbar 60 in position, a cylindrical projection 260 having a central aperture 262 therethrough is formed at the inwardly-facing surface of intermediate portion 206. One end of crossbar 60 is inserted into aperture 262, and is retained therein by a conventional vandal-resistant fastener 264.

Base portion 200 terminates in outwardly-extending feet 270. Longitudinal apertures 272 can be formed therethrough for receiving fasteners (not show) for securing bench 10 to the ground or other surface on which it rests.

Locking cap 300 is configured to provide proper alignment between seat portion 100, base portion 200, and the locking joint between them, as well as to provide a vandal-resistant cover for the locking joint. Locking cap 300 includes a longitudinally-extending body portion 302, an interior surface 304 (which faces towards seat portion 100 and base portion 200), and an exterior surface 306 (which faces away from seat portion 100 and base portion 200).

A laterally-extending upper wedge portion 310 projects from interior surface 304 at the upper edge of body portion 302, and is insertable between the lower surface of forward and rearward shoulders 110*a* and 110*b* and the upper surface of projecting rib 230. The facing surfaces of wedge portion 310, the lower surface of forward and rearward shoulders 110*a* and 110*b* and the upper surface of projecting rib 230 must be true, in order for locking cap 300 to accomplish its alignment function. Forward and rearward apertures 312*a* and 312*b* are formed through wedge portion 310 in vertical alignment with apertures 112*a* and 112*b* in shoulders 110*a* and 110*b* and with apertures 234*a* and 234*b* in projecting rib 230, for receiving shafts 134 of the fastening bolts.

A projecting rib 320 projects from interior surface 304 at the lower edge of body portion 302 parallel to wedge portion 310. A longitudinally-extending semi-cylindrical projection 322 also projects from interior surface 304, extending upwardly from projecting rib 320 through wedge portion 310, for mating engagement with U-shaped notch 232 and semi-cylindrical longitudinal depression 252 in base portion 200, as will be described in greater detail hereinafter. A longitudinally-extending semi-cylindrical depression 324 complementary to projection 322 is formed in exterior surface 306.

Forward and rearward trapezoidal projections 330*a* and 330*b* are also formed in interior surface 304. They extend laterally from semi-cylindrical projection 322, and upwardly from projecting rib 320, and are spaced downwardly from wedge portion 310. Triangular depressions 332*a* and 332*b* are formed in interior surface 304, at the lateral termination of trapezoidal projections 330*a* and 330*b*, and define the interior portions of the nut seats.

To assemble left and right frame assemblies 20 and 30, lower surface 104 of seat portion 100 is brought together with upper end 202 of base portion 200 with male portions 114*a* and 114*b* of the dovetail half-lap joints in engagement with female portions 220*a* and 220*b*. Hexagonal nuts 250 are placed in the outer portions of the nut seats, that is, in recesses 240*a* and 240*b*. Locking cap 300 is then placed over the locking joint, with wedge portion 310 inserted between the lower surface of forward and rearward shoulders 110*a* and 110*b* and the upper surface of projecting rib 230, with semi-cylindrical projection 322 of locking cap 300 in engagement with semi-cylindrical depression 252 in the upper end 202 of base portion 200, and with triangular depressions 332*a* and 332*b* in registration with recesses 240*a* and 240*b* and in engagement with nuts 250. The mating engagement of semi-cylindrical projection 322 with semi-cylindrical depression 252 aids in the proper alignment of locking cap 300; and more specifically, ensures that its apertures 312*a* and 312*b* are in axial alignment with apertures 112*a* and 112*b* of seat portion 100 and with apertures 234*a* and 234*b* of base portion 200, and that triangular depressions 332*a* and 332*b* are in alignment with recesses 240*a* and 240*b* so as to engage nuts 250. Nuts 250 thus are seated against rotation.

After locking cap 300 has been properly placed relative to seat portion 100 and base portion 200, shafts 134 of the fastening bolts are assembled to washers 132 and heads 130 and washers 132 are placed in fastener seats 120*a* and 120*b*, with shafts 134 extending through aligned notch 112*a* and apertures 312*a* and 234*a* and aligned notch 112*b* and apertures 312*b* and 234*b*. A conventional wrench is then applied to heads 130 to tighten the fastening bolts, the nut seats preventing rotation of nuts 250 as torque is applied to heads 130.

As the fastening bolts are tightened, the facing surfaces of seat portion 100, base portion 200, and locking cap 300, which are all planar, are brought into close contact, resulting in proper permanent alignment of all parts. Frame assemblies 20 and 30 can then be assembled to slats 40 and crossbar 60. The ends of slats 40 are held in place in channels 106 by conventional vandal-resistant fasteners (for example, screws or bolts with one-way heads) inserted into the ends of slats 40 through apertures 142 in lower surfaces 104 of seat portions 100. As previously described, the ends of crossbar 60 are received in apertures 262 and are held in place by vandal-resistant fasteners 264. Center brace 50 is attached to the rear or lower surfaces of slats 40 intermediate left and right frame assemblies 20 and 30, also using vandal-resistant fasteners (not shown). Once in place, slats 40 cover heads 30. As slats 40 are held in place by vandal-resistant fasteners, it is virtually impossible for a vandal to access heads 130 to disassemble frame assemblies 20 and 30.

Further, the forces acting to hold bench 10 together render it very stable. Specifically, the fastening bolts holding frame assemblies 20 and 30 together exert forces acting along axes which is perpendicular or nearly perpendicular to the surface on which bench 10 rests. Fasteners 264 affixing frame assemblies 20 and 30 exert forces acting along a common axis parallel to the surface and in a direction toward the center of bench 10. Finally the fasteners affixing slats 40 to seat portion 100 act along axes generally perpendicular to lower surface 104 at the point of insertion.

Referring now to FIGS. 12–16, there is shown a second embodiment of the joint between the seat and base portions of a vandal-resistant frame in accordance with the present invention. The second embodiment is generally similar to the first embodiment described with respect to FIGS. 2–11. Thus, only the modifications are described herein.

Seat portion 100' has the same parts as seat portion 100, seat portion 100' differing from seat portion 100 in that forward and rear shoulders 110*a* and 110*b* are provided with apertures 112*a'* and 112*b'* rather than with notches 112*a* and 112*b* for receiving shafts 134 of the fastening bolts. Base portion 200' has the same parts as base portion 200, base portion 200' differing from base portion 200 in that transverse raised portion 222 is provided with recesses 240*a'* and 240*b'* which are rectangular in transverse cross-section (rather than triangular, as are recesses 240*a* and 240*b*) for seating square for seating square nuts 250'. Locking cap 300 is the same in both embodiments, with the planar longitudinal surfaces of trapezoidal projections 330*a* and 330*b* defining the outer portions of the nut seats which engage nuts 250'.

Figure 17:
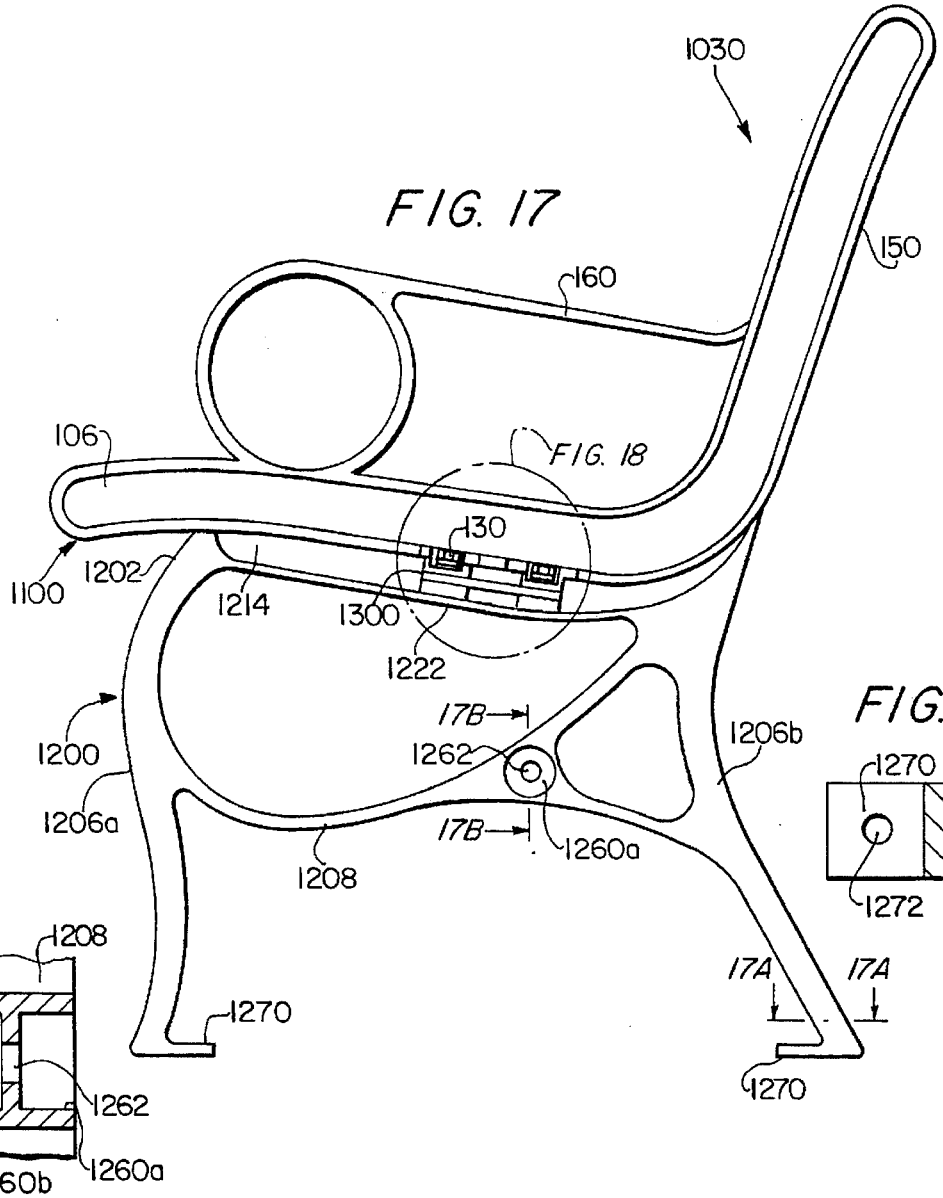
FIG. 17 is an elevational view of the inner side of a second embodiment of a vandal-resistant frame in accordance with present invention.
Figure 17A:
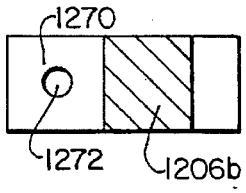
FIG. 17A is a cross-sectional view taken along line 17A—17A of FIG. 17.

Referring now to FIG. 17, there is shown a right vandal-resistant frame assembly 1030 for a vandal-resistant bench in accordance with a second embodiment of the invention. The left vandal-resistant frame assembly (not shown) is a mirror-image of fight frame assembly 1030.

Frame assembly 1030 includes a seat portion 1100, a base portion 1200, and a spacer 1300 for aligning the locking joint between seat and base portions 1100 and 1200. Preferably, seat portion 1100, base portion 1200, and spacer 1300 are all cast iron. As with the embodiment of FIGS. 1 and 2, both seat portion 100 and base portion 200 can be cast on an automatic machine.

Seat portion 1100 is generally similar to seat portion 100', described above with respect to FIG. 16.

Base portion 1200 includes a seat-supporting upper end 1202, front and back legs 1206*a* and 1206*b* extending downwardly from upper end 1202, and a brace 1208 extending transversely between front and back legs 1206*a* and 1206*b*. Although illustrated in FIG. 17 as having legs, base portion 1200 can be in the form of a pedestal having the shape of an inverted "T," as in FIGS. 1 and 2, or other configurations which permit inclusion of the locking joint.

An inwardly-facing recess 1214 is formed in the seat supporting end 1202 between front and back legs 1206*a* and 1206*b* above a transversely extending rib 1222. Forward and rearward adjacent female portions 1220*a* and 1220*b* of the forward and rearward dovetail half-lap joints are formed in the inwardly-facing surface of recess 1214 for respectively matingly receiving forward and rearward male portions 114*a* and 114*b* of seat portion 1100. Forward and rearward shoulders 1230*a* and 1230*b* extend upwardly and outwardly of rib 1222 below and in alignment with forward and rearward female portions 1220*a* and 1220*b*, respectively. Forward and rearward apertures 1234*a* and 1234*b* are formed in forward and rearward shoulders 1230*a* and 1230*b*, respectively, in alignment with apertures 112*a'* and 112*b'* of seat portion 1100, for receiving shafts 134 of the fastening bolts. Forward and rearward apertures 1234*a* and 1234*b* are internally threaded to retain shafts 134 of the bolts, as described in greater detail hereinafter.

Figure 17B:
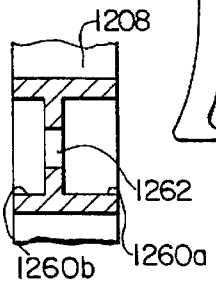
FIG. 17B is a cross-sectional view taken along line 17B—17B of FIG. 17.
Figure 18:
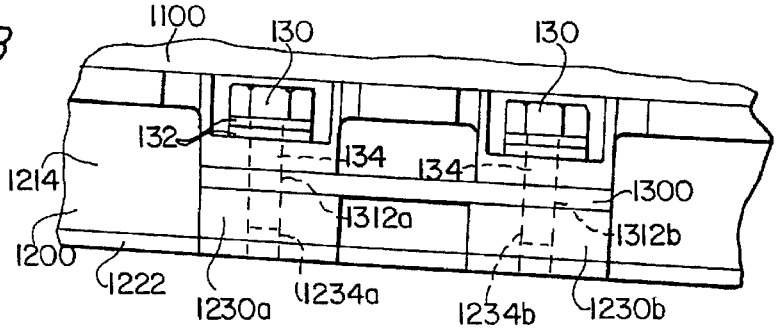
FIG. 18 is an enlarged view of the area enclosed by the broken line circle in FIG. 17.
Figure 19:
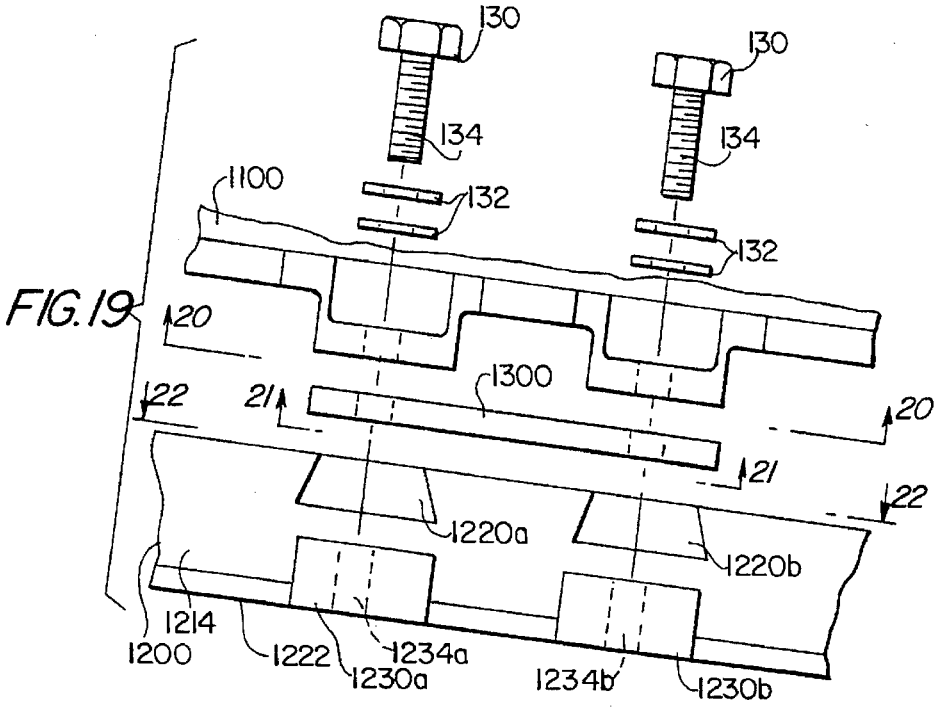
FIG. 19 is an exploded view of the joint between the seat and base portions shown in FIG. 18.
Figure 20:
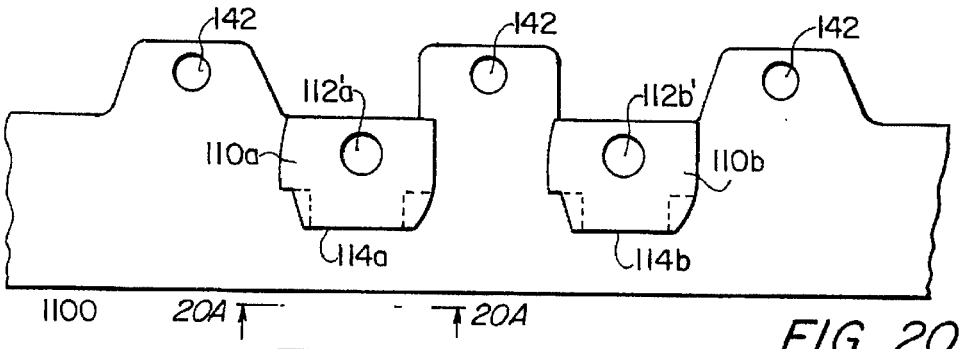
FIG. 20 is a cross-sectional view taken along line 20—20 of FIG. 19.
Figure 20A:
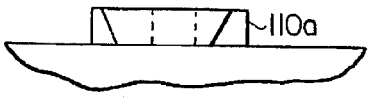
FIG. 20A is a cross-sectional view taken along line 20A—20A of FIG. 20.
Figure 21:
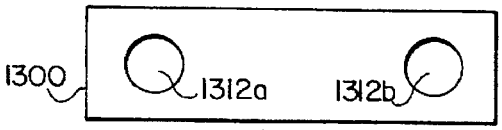
FIG. 21 is a cross-sectional view taken along line 21—21 of FIG. 19.
Figure 22:
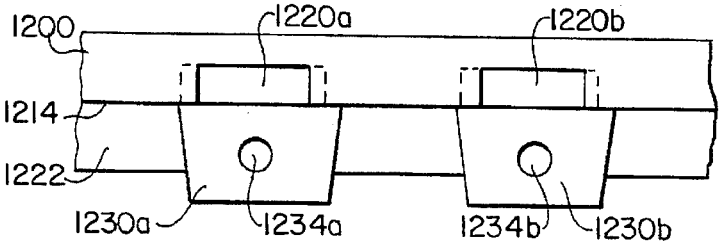
FIG. 22 is a cross-sectional view taken along line 22—22 of FIG. 19.

Referring now to FIGS. 17 and 17B, in order to retain a crossbar in position as shown in FIG. 1, concentric cylindrical recesses 1260*a* and 1260*b* are formed in the inner and outer surfaces, respectively, of brace 1208. A central aperture 1262 extends between recesses 1260*a* and 1260*b*. One end of the crossbar is into inner recess 1260*a* and through aperture 1262, and is retained therein by a conventional vandal-resistant fastener seated in outer recess 1260*b*.

Legs 1206*a* and 1206*b* terminate in outwardly-extending feet 1270. Longitudinal apertures 1272 can be formed therethrough for receiving fasteners (not shown) for securing the bench to the ground or other surface on which it rests.

Spacer 1300 is configured to provide proper alignment between seat portion 1100, base portion 1200, and the locking joint between them. Spacer 1300 is a bar of rectangular prismatic configuration, having upper and lower planar surfaces, and insertable between the lower surfaces of forward and rearward shoulders 110*a* and 110*b* and the upper surfaces of forward and rearward shoulders 1230*a* and 1230*b*. As with locking cap 300, the facing surfaces of spacer 1300, the lower surfaces of forward and rearward shoulders 110*a* and 110*b* and the upper surfaces of forward and rearward shoulders 1230*a* and 1230*b* must be true in order for spacer 1300 to accomplish its alignment function. Forward and rearward apertures 1312*a* and 1312*b* are formed through spacer 1300 in vertical alignment with forward and rearward apertures 1234*a* and 1234*b* and apertures 112*a'* and 112*b'*, for receiving shafts 134 of fastening bolts 130.

To assemble the left and right frame assemblies, lower surface 1104 of seat portion 1100 is brought together with upper end 1202 of base portion 1200 with male portions 1114*a* and 1114*b* of the dovetail half-lap joints in engagement with female portions 1220*a* and 1220*b* with spacer 1300 inserted between the lower surfaces of forward and rearward shoulders 1110*a* and 1110*b* and the upper surfaces of forward and rearward shoulders 1230*a* and 1230*b*.

After spacer 1300, seat portion 1100 and base portion 1200 have been properly placed relative to each other, shafts 134 of the fastening bolts are assembled to washers 132 and heads 130 and washers 132 are placed in fastener seats 120*a* and 120*b*, with shafts 134 extending through aligned apertures 112*a'*, 1312*a*, and 1234*a* and aligned apertures 112*b'*, 1312*b*, and 1234*b*. A conventional wrench is then applied to heads 130 to tighten the fastening bolts.

As the fastening bolts are tightened, the facing surfaces of seat portion 1100, base portion 1200, and spacer 1300, which are all planar, are brought into close contact, resulting in proper permanent alignment of all parts. The frame assemblies 30 can then be assembled to the slats and crossbar, and a center brace can be attached to the rear or lower surfaces of the slats intermediate the left and right frame assemblies, also using vandal-resistant fasteners, as described above with respect to FIGS. 1 and 2. As previously described, the ends of the crossbar are received in recesses 1260*a* and apertures 1262 and are held in place by vandal-resistant fasteners. Once in place, the slats cover heads 130 of the fasteners. As with the embodiment shown in FIGS. 1 and 2, because the slats are held in place by vandal-resistant fasteners, it is virtually impossible for a vandal to access heads 130 to disassemble the frame assemblies.

Modifications and variations of the above-described embodiments of the present invention are possible, as appreciated by those skilled in the art in light of the above teachings. For example, the overall shapes of seat portion 100 and base portion 200 can be varied. Also, the locking joint can comprise left and right, rather than forward and rearward, dovetail half-lap joints; or can comprise one elongated dovetail half-lap joint, rather than a pair; or can comprise more than two adjacent dovetail half-lap joints. Further, in the embodiments shown in FIGS. 1–16, apertures 234*a* and 234*b* can be internally threaded as in the embodiment shown in FIGS. 17–22, so that nuts are not required to retain the shafts 134 of the fastening bolts. The nut seats are then superfluous, and as in the embodiment shown in FIGS. 17–22, need not be provided.

It is therefore to be understood that, within the scope of the appended claims and their equivalents, the invention may be practiced otherwise than as specifically described.

What is claimed is:

1. A vandal-resistant frame assembly for a seat, said frame assembly comprising:

a seat portion having an upper surface and a lower surface, said lower surface having at least one male portion of a locking joint formed integrally therewith, and said seat portion having an associated fastener seat in lateral alignment with said at least one male portion of said locking joint, said seat portion being unitarily formed as a single piece; and a base portion formed separately from said seat portion, said base portion having a seat-supporting upper end and a lower end adapted to engage a support surface, said upper end having integrally formed therein at least one female portion of said locking joint for matingly receiving said at least one male portion of said locking joint, said base portion being unitarily formed as a single piece;

wherein said seat portion and said base portion are both formed of a cast metal.

2. The frame assembly of claim 1, wherein said seat portion has first and second adjacent male portions of said locking joint and said base portion has first and second adjacent female portions of said locking joint for respectively matingly receiving said first and second male portions of said locking joint.

3. The frame assembly of claim 1, wherein said seat portion includes a seating area-receiving channel extending between said upper and lower surfaces.

4. The frame assembly of claim 1, wherein said seat portion and said base portion are both formed of cast iron.

5. A vandal-resistant frame assembly for a seat, said frame assembly comprising:

a seat portion having an upper surface and a lower surface, said lower surface having at least one male portion of a locking joint formed integrally therewith, said seat portion having an associated fastener seat in lateral alignment with said at least one male portion of said locking joint, said seat portion being unitarily formed as a single piece, and said seat portion having first and second adjacent male portions of said locking joint and first and second fastener seats; and a base portion formed separately from said seat portion, said base portion having a seat-supporting upper end and a lower end adapted to engage a support surface, said upper end having integrally formed therein first and second adjacent female portions of said locking joint for respectively matingly receiving said first and second male portions of said locking joint, said base portion being unitarily formed as a single piece and wherein said base portion further includes first and second nut seats in lateral alignment with said first and second female portions of said locking joint and in longitudinal alignment with said first and second fastener seats, said first and second nut seats being configured to prevent rotation of a nut seated therein.

6. The frame assembly of claim 5, wherein said first and second fastener seats have coplanar lower surfaces, and wherein said base portion includes a transverse projecting rib intermediate said first and second nut seats and said first and second female portions of said locking joint, said transverse projecting rib having an upper surface spaced from said lower surfaces of said first and second fastener seats when said first and second male portions are matingly received in said first and second female portions of said locking joint; and wherein said frame assembly further comprises a locking cap, said locking cap including a laterally-extending wedge portion insertable between said lower surfaces of said first and second fastener seats and said upper surface of said transverse projecting rib for aligning mating surfaces of said seat portion and said base portion.

7. The frame assembly of claim 6, wherein said lower surface of said seat portion at said fastener seats, said wedge portion of said locking cap, and said base portion at said transverse projecting rib have aligned apertures therethrough for receiving fasteners threadably engaging nuts seated in said nut seats.

8. The frame assembly of claim 6, wherein said lower surface of said seat portion at said fastener seats has notches therein, and wherein said wedge portion of said locking cap and said base portion at said transverse projecting rib have aligned apertures therethrough, said apertures also being aligned with said notches for receiving fasteners threadably engaging nuts seated in said nut seats.

9. The frame assembly of claim 6, wherein said locking cap further includes a longitudinally-extending cover portion for covering said first and second nut seats, said transverse projecting rib extending outwardly from said cover portion.

10. The frame assembly of claim 9, wherein said longitudinally-extending cover portion includes inner and outer surfaces and first and second nut seats formed in said inner surface for alignment with said first and second nut seats of said base portion.

11. A vandal-resistant frame assembly for a seat, said frame assembly comprising:

a seat portion having an upper surface and a lower surface, said lower surface having first and second adjacent male portions of a locking joint formed integrally therewith, and said seat portion having associated first and second fastener seats in lateral alignment with said at least one male portion of said locking joint; and a base portion formed separately from said seat portion, said base portion having a seat-supporting upper end and a lower end adapted to engage a support surface, said upper end having formed therein first and second adjacent female portions of said locking joint for respectively matingly receiving said first and second male portions of said locking joint, wherein said seat portion has first and second fastener seats, and first and second nut seats in lateral alignment with said first and second female portions of said locking joint and in longitudinal alignment with said first and second fastener seats, said first and second nut seats being configured to prevent rotation of a nut seated therein, wherein when said base portion is resting on a horizontal support surface, said first and second nut seats have coplanar upper surfaces forming an angle with a horizontal plane, said upper surfaces of said first and second nut seats tilting downwardly from front to back.

12. A vandal-resistant frame assembly for a seat, said frame assembly comprising:

a seat portion having an upper surface and a lower surface, said lower surface having first and second adjacent male portions of a locking joint formed integrally therewith, and said seat portion having associated first and second fastener seats in lateral alignment with said male portions of said locking joint, wherein said first and second fastener seats have coplanar lower surfaces;

a base portion formed separately from said seat portion, said base portion having a seat-supporting upper end and a lower end adapted to engage a support surface, said upper end having formed therein first and second adjacent female portions of said locking joint for respectively matingly receiving said first and second male portions of said locking joint, wherein said base portion includes at said upper end thereof first and second shoulders below and in alignment with said first and second female portions of said locking joint, said first and second shoulders having coplanar upper surfaces spaced from said lower surfaces of said first and second fastener seats when said first and second male portions are matingly received in said first and second female portions of said locking joint; and a spacer, said spacer being dimensioned for insertion between said lower surfaces of said first and second fastener seats and said upper surfaces of said first and second shoulders for aligning mating surfaces of said seat portion and said base portion.

13. The frame assembly of claim 12, wherein said lower surface of said seat portion at said fastener seats, said spacer, and said first and second shoulders of said base portion have aligned apertures therethrough for receiving fasteners.

14. The frame assembly of claim 13, wherein said apertures in said first and second shoulders are internally threaded for retaining externally-threaded fasteners.

15. The frame assembly of claim 3, wherein said lower surface of said seat portion has fastener-receiving apertures therethrough in communication with said channel.

16. A vandal-resistant frame assembly for a seat, said frame assembly comprising:

a seat portion having an upper surface and a lower surface, said lower surface having at least one male portion of a locking joint formed integrally therewith, and said seat portion having an associated fastener seat in lateral alignment with said at least one male portion of said locking joint, said seat portion being unitarily formed as a single piece; and a base portion formed separately from said seat portion, said base portion having a seat-supporting upper end and a lower end adapted to engage a support surface, and said base portion also including an aperture spaced downwardly from said upper end for receiving a crossbar; and a base portion formed separately from said seat portion, said base portion having a seat-supporting upper end and a lower end adapted to engage a support surface, said upper end having integrally formed therein at least one female portion of said locking joint for matingly receiving said at least one male portion of said locking joint, said base portion being unitarily formed as a single piece.

17. A vandal-resistant frame assembly for a seat, said frame assembly comprising:

a seat portion having an upper surface and a lower surface, said lower surface having at least one male portion of a locking joint formed integrally therewith, and said seat portion having an associated fastener seat in lateral alignment with said at least one male portion of said locking joint, said seat portion being unitarily formed as a single piece; and a base portion formed separately from said seat portion, said base portion having a seat-supporting upper end and a lower end adapted to engage a support surface, said base portion further including at least one nut seat in lateral alignment with at least one female portion of said locking joint and in longitudinal alignment with said fastener seat, said at least one nut seat being configured to prevent rotation of a nut seated therein, and said upper end having integrally formed therein said at least one female portion of said locking joint for respectively matingly receiving said at least one male portion of said locking joint, said base portion being unitarily formed as a single piece.

18. The frame assembly of claim 17, wherein said fastener seat has a lower surface, and wherein said base portion includes a transverse projecting rib intermediate said at least one nut seat and said at least one female portion of said locking joint, said transverse projecting rib having an upper surface spaced from said lower surface of said fastener seat when said at least one male portion is matingly received in said female portion of said locking joint; and wherein said frame assembly further comprises a locking cap, said locking cap including a laterally-extending wedge portion insertable between said lower surface of said fastener seat and said upper surface of said transverse projecting rib for aligning mating surfaces of said seat portion and said base portion.

19. The frame assembly of claim 18, wherein said lower surface of said seat portion at said fastener seat, said wedge portion of said locking cap, and said base portion at said transverse projecting rib have at least one aligned aperture therethrough for receiving a fastener threadably engaging a nut seated in said at least one nut seat.

20. The frame assembly of claim 18, wherein said locking cap further includes a longitudinally-extending cover portion for covering said at least one nut seat, said transverse projecting rib extending outwardly from said cover portion.

21. The frame assembly of claim 20, wherein said longitudinally-extending cover portion includes inner and outer surfaces and at least one nut seat formed in said inner surface for alignment with said at least one nut seat of said base portion.

22. A vandal-resistant frame assembly for a seat, said frame assembly comprising:

a seat portion having an upper surface and a lower surface, said lower surface having at least one male portion of a locking joint formed integrally therewith, and said seat portion having an associated fastener seat in lateral alignment with said at least one male portion of said locking joint; and a base portion formed separately from said seat portion, said base portion having a seat-supporting upper end and a lower end adapted to engage a support surface, said upper end having formed therein at least one female portion of said locking joint for matingly receiving said at least one male portion of said locking joint, said base portion also having formed therein at least one nut seat in lateral alignment with said at least one female portion of said locking joint and in longitudinal alignment with said fastener seat, said at least one nut seat being configured to prevent rotation of a nut seated therein, wherein when said base portion is resting on a horizontal support surface, said at least one nut seat has an upper surface forming an angle with a horizontal plane, said upper surface of said at least one nut seat tilting downwardly from front to back.

23. A vandal-resistant frame assembly for a seat, said frame assembly comprising:

a seat portion having an upper surface and a lower surface, said lower surface having at least one male portion of a locking joint formed integrally therewith, and said seat portion having an associated fastener seat in lateral alignment with said at least one male portion of said locking joint, wherein said fastener seat has a lower surface;

a base portion formed separately from said seat portion, said base portion having a seat-supporting upper end and a lower end adapted to engage a support surface, said upper end having formed therein at least one female portion of said locking joint for matingly receiving said at least one male portion of said locking joint, wherein said base portion includes at said upper end thereof at least one shoulder below and in alignment with said at least one female portion of said locking joint, said at least one shoulder having an upper surface spaced from said lower surface of said fastener seat when said at least one male portion is matingly received in said at least one female portion of said locking joint; and a spacer, said spacer being dimensioned for insertion between said lower surface of said fastener seat and said upper surface of said at least one shoulder for aligning mating surfaces of said seat portion and said base portion.

24. The frame assembly of claim 23, wherein said lower surface of said seat portion at said fastener seat, said spacer, and said at least one shoulder of said base portion have aligned apertures therethrough for receiving fasteners.

25. The frame assembly of claim 24, wherein said aperture in said at least one shoulder is internally threaded for retaining an externally-threaded fastener.

26. A vandal-resistant article of furniture comprising:

left and right mirror-image frames, each said frame comprising:

a seat portion having an upper surface and a lower surface, said lower surface having first and second adjacent male portions of a locking joint formed integrally therewith, and first and second fastener seats in lateral alignment with said first and second male portions of said locking joint;

a base portion formed separately from said seat portion, said base portion having a seat-supporting upper end and a lower end adapted to engage a support surface, said upper end having formed therein first and second female portions of said locking joint respectively matingly receiving said first and second male portions of said locking joint; and first and second fasteners having heads respectively seated on said first and second fastener seats and having shafts engaging said upper end of said base portion; and a seating area extending between and fastened to said seat portions of said left and right frames.

27. The article of furniture of claim 26, wherein each said frame further comprises first and second nut seats formed in said base portion in lateral alignment with said first and second female portions of said locking joint and in longitudinal alignment with said first and second fastener seats, said first and second nut seats being configured to prevent rotation of nuts seated therein; and first and second nuts respectively seated in said first and second nut seats, said shafts of said fasteners respectively engaging said first and second nuts.

28. The article of furniture of claim 27, wherein when said seat portion is resting on a horizontal support surface, said first and second nut seats have coplanar upper surfaces forming an angle with a horizontal plane, said upper surfaces of said first and second nut seats tilting downwardly from front to back.

29. The article of furniture of claim 27, wherein said first and second fastener seats have coplanar lower surfaces, and wherein said base portion includes a transverse projecting rib intermediate said first and second nut seats and said first and second female portions of said locking joints, said transverse projecting rib having an upper surface spaced from said lower surfaces of said first and second fastener seats when said first and second male portions are matingly received in said first and second female portions of said locking joint; and wherein said article further comprises a locking cap, said locking cap including a laterally-extending wedge portion inserted between said lower surfaces of said first and second fastener seats and said upper surface of said transverse projecting rib and aligning mating surfaces of said seat portions and said base portion.

30. The article of furniture of claim 29, wherein said locking cap further includes a longitudinally-extending cover portion covering said first and second nut seats, said transverse projecting rib extending outwardly from said cover portion.

31. The article of furniture of claim 30, wherein said longitudinally-extending cover portion includes inner and outer surfaces and first and second seat nuts formed in said inner surface in alignment with said first and second seat nuts of said base portion, said first and second seat nuts of said base portion and said cover portion together locking said nuts against rotation.

32. The article of furniture of claim 26, wherein said first and second fastener seats have coplanar lower surfaces, and wherein said base portion includes at said upper end thereof first and second shoulders below and in alignment with said first and second female portions of said locking joints, said first and second shoulders having coplanar upper surfaces spaced from said lower surfaces of said first and second fastener seats when said first and second male portions are matingly received in said first and second female portions of said locking joint; and wherein said article of furniture further comprises a spacer, said spacer being inserted between said lower surfaces of said first and second fastener seats and said upper surfaces of said first and second shoulders for aligning mating surfaces of said seat portion and said base portion.

33. The article of furniture of claim 32, wherein said lower surface of said seat portion at said fastener seats, said spacer, and said first and second shoulders of said base portion have aligned apertures therethrough for receiving said fasteners.

34. The article of furniture of claim 33, wherein said apertures in said first and second shoulders are internally threaded for retaining externally-threaded fasteners.

35. The article of furniture of claim 26, wherein said seat portion includes a channel extending between said upper and lower surfaces, and said seating area has left and right ends; and wherein said left end of said seating area is received in said channel of said seat portion of said left frame and said right end of said seating area is received in said channel of said seat portion of said right frame.

36. The article of furniture of claim 35, wherein said lower surface of said seat portion has fastener-receiving apertures therethrough in communication with said channel; and wherein said article of furniture further comprises fasteners extending through said fastener-receiving apertures and into said seating area.

37. The article of furniture of claim 36, wherein said article of furniture further comprises a cross-bar extending between and attached to said base portions.

38. The article of furniture of claim 37, wherein each said base portion includes an aperture spaced downwardly from said upper end for receiving said cross-bar; and wherein said article of furniture further comprises left and right fasteners fastening said cross-bar to each said base portion at said aperture.

39. The article of furniture of claim 26, wherein said seat portion and said base portion of each said frame are both formed of cast iron.

40. A vandal-resistant article of furniture comprising:

left and right mirror-image frames, each said frame comprising:

a seat portion having an upper surface and a lower surface, said lower surface having at least one male portion of a locking joint formed integrally therewith, and at least one associated fastener seat in lateral alignment with said at least one male portion of said locking joint;

a base portion formed separately from said seat portion, said base portion having a seat-supporting upper end and a lower end adapted to engage a support surface, said upper end having formed therein at least one female portion of said locking joint matingly receiving said at least one male portion of said locking joint; and at least one fastener having a head seated on said at least one fastener seat and having a shaft engaging said upper end of said base portion; and a seating area extending between and fastened to said seat portions of said left and right frames.

41. The article of furniture of claim 40, wherein said seat portion and said base portion of each said frame are both formed of cast iron.

42. A vandal-resistant article of furniture comprising:

left and right mirror-image frames, each said frame comprising:

a seat portion having an tipper surface and a lower surface, said lower surface having first and second adjacent male portions of a locking joint formed integrally therewith, and first and second fastener seats in lateral alignment with said first and second male portions of said locking joint;

a base portion formed separately from said seat portion, said base portion having a seat-supporting upper end and a lower end adapted to engage a support surface, said upper end having formed therein first and second female portions of said locking joint respectively matingly receiving said first and second male portions of said locking joint; and first and second fasteners having heads respectively seated on said first and second fastener seats and having shafts engaging said upper end of said base portion; and a seating area extending between and fastened to said seat portions of said left and right frames.

43. The article of furniture of claim 42, wherein said seat portion and said base portion of each said frame are both formed of cast iron.

44. A vandal-resistant frame assembly for a bench-like article of furniture, said frame assembly comprising:

a seat portion having upper and lower surfaces and inner and outer edges, said lower surface having a first portion of a locking joint adjacent said outer edge of said seat portion and formed integrally therewith;

a base portion formed separately from said seat portion, said base portion having a seat-supporting upper end, a lower end adapted to engage a support surface, and inner and outer edges, said upper end having formed therein adjacent said outer edge of said base portion a second portion of said locking joint for mating engagement with said first portion of said locking joint, and said upper end further having formed therein at least one shoulder spaced downwardly from said second portion of said locking joint; and a spacer insertable between said lower surface of said seat portion and said upper end of said base portion at said locking joint;

said lower surface of said seat portion, said upper end of said base portion, and said spacer all having alignable apertures therethrough for receiving a fastener.

45. The article of furniture of claim 44, wherein said seat portion and said base portion are both formed of cast iron.

* * * * *